US006073308A

United States Patent [19]

Linnenbrink et al.

[11] Patent Number: 6,073,308

[45] Date of Patent: Jun. 13, 2000

[54] COMBINED DOOR CHECK AND HINGE ASSEMBLY FOR MOTOR VEHICLE DOORS

[75] Inventors: Jörg Linnenbrink, Wuppertal; Jürgen Wiesner, Velbert, both of Germany

[73] Assignee: Friedr. Fingscheidt GmbH, Velbert, Germany

[21] Appl. No.: 09/121,251

[22] Filed: Jul. 23, 1998

[30] Foreign Application Priority Data

Jul. 23, 1997 [DE] Germany ..... 297 13 031 U

[51] Int. Cl.[7] ..... E05D 11/10

[52] U.S. Cl. ..... 16/334; 16/263

[58] Field of Search ..... 16/334, 335, 332, 16/321, 375, 374, 344, 327, 261–264, 380, 381

[56] References Cited

U.S. PATENT DOCUMENTS

| | | | |
|---|---|---|---|
| 2,992,451 | 7/1961 | Schonitzer et al. | 16/286 |
| 4,765,025 | 8/1988 | Salazar | 16/261 |
| 4,800,623 | 1/1989 | Brockhaus | 16/263 |
| 4,854,009 | 8/1989 | Brockhaus | 16/263 |
| 5,067,201 | 11/1991 | Marchione | 16/332 |
| 5,761,769 | 6/1998 | Bruckner et al. | 16/342 |

FOREIGN PATENT DOCUMENTS

| | | |
|---|---|---|
| 2640674 | 6/1990 | France . |
| 3137134A1 | 7/1982 | Germany . |
| 296 14 386 U | 12/1996 | Germany . |
| 296 11 580 U | 2/1997 | Germany . |
| 1509057 | 4/1978 | United Kingdom . |

*Primary Examiner*—Chuck Y. Mah
*Attorney, Agent, or Firm*—Harness, Dickey & Pierce, P.L.C.

[57] ABSTRACT

The present invention concerns a hinged door check, for vehicle doors in particular, consisting of two hinged parts (2,4) which are connected swivelling around an axis of rotation (8) by a hinge pin (6) and which have a holding device (10) integrated between them defining different relative rotational positions. The holding device (10) consists first of at least one catch element (12) kinematically connected with the first hinged part (2) and spring-loaded in a working direction perpendicular to the axis of rotation (8), and secondly of a track (16) kinematically connected with the second hinged part (4), essentially shaped like the sector of a circle and arranged coaxial to the axis of rotation (8) with respect to its radius of curvature, having at least one latching point (14) cooperating with the catch element (12). The hinge pin (6) is connected detachable from the first hinged part (2) by fasteners (26), so that the hinged parts (2, 4) are separable when unloosening the fasteners (26) while keeping the connection between the hinge pin (6) and the second hinged part (4) and the holding device (10) assigned to the latter.

23 Claims, 7 Drawing Sheets

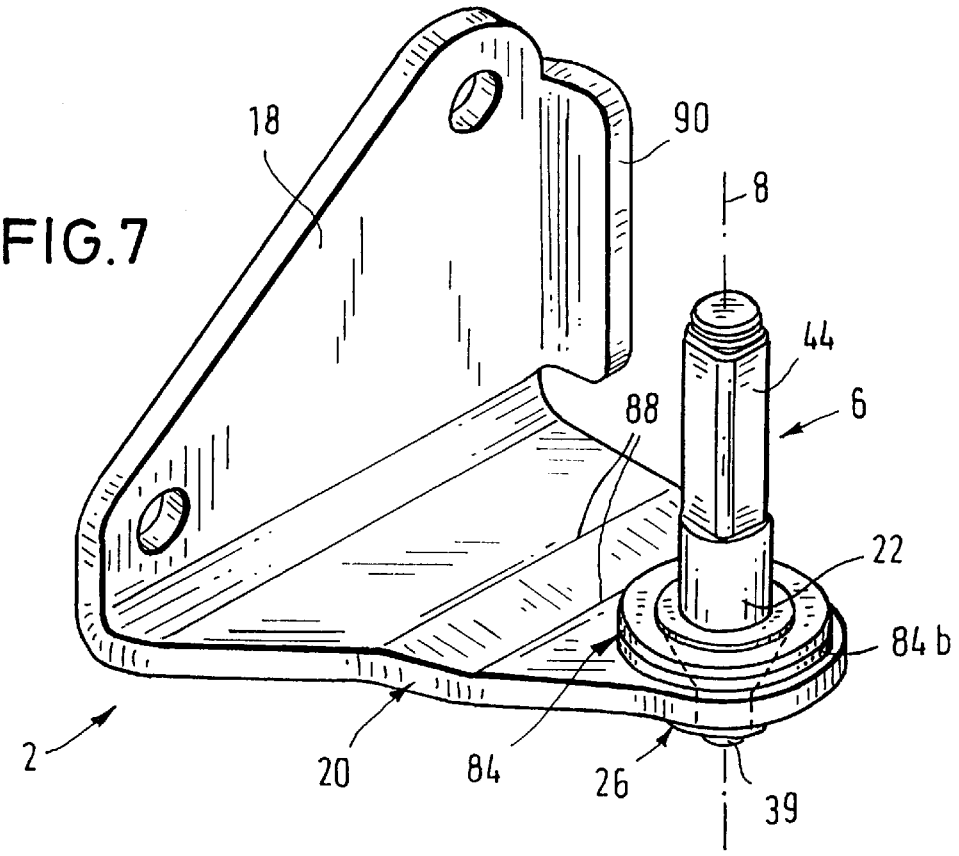
FIG.7
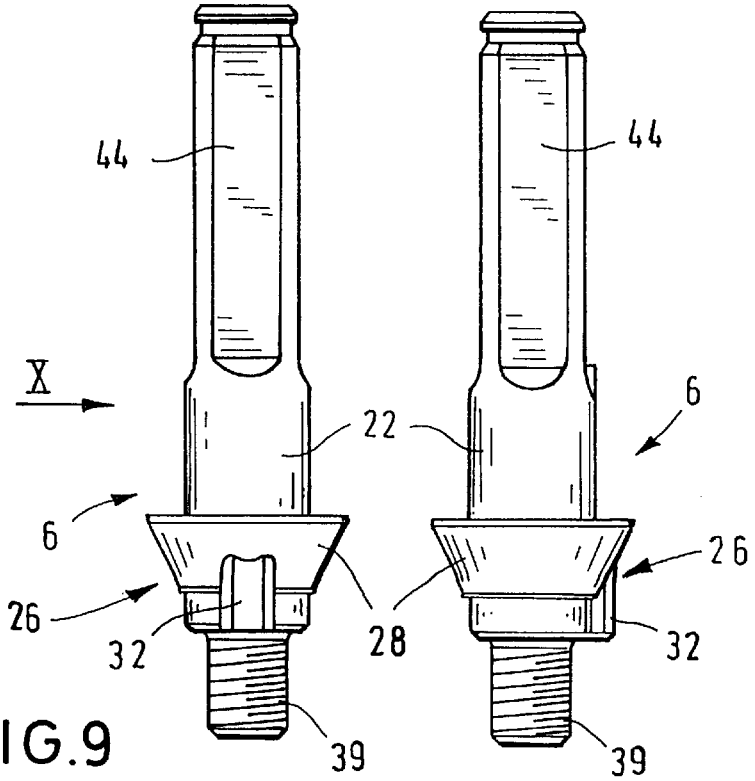
FIG.9
FIG.10

COMBINED DOOR CHECK AND HINGE ASSEMBLY FOR MOTOR VEHICLE DOORS

BACKGROUND AND SUMMARY OF THE INVENTION

The present invention concerns a hinged door check for vehicle doors consisting of two hinged parts which are pivotally connected around an axis of rotation by a hinge pin and which have a holding device integrated between them defining different relative rotational positions, whereby the holding device consists first of at least one catch element kinematically connected with the first hinged part and spring-loaded in a working direction perpendicular to the axis of rotation, and secondly of a track kinematically connected with the second hinged part, essentially shaped like the sector of a circle and arranged coaxial to the axis of rotation with respect to its radius of curvature, having at least one latching point cooperating with the catch element to hold the door in defined rotational position.

A hinged door check of this type ("door hinge with integrated door check") has become well known from DE 31 37 134 A1. It is characteristic of this type first of all, that the swivelling or pivot axis of the door check's catch element corresponds to the hinge's axis of rotation and, secondly, that a track merely extending over a graduated circle (sector) is provided. This produces a compact structural shape. The well known hinged door check is described in different embodiments, and first of all with the direction of the catch element working radially from outside to inside (FIGS. 1 through 3) in one respect, and from inside to outside (FIGS. 6 and 7) in another respect. An embodiment with axial catch direction is also disclosed (FIG. 4). Uncoupling of the hinged parts and the vehicle's door is difficult for the well known hinged door check because the entire holding device falls apart after separating the hinged parts by removing the hinge pin. Reassembly is at least difficult. Because of the relatively large spring resistance, since special tools are required.

The objective of the present invention is to create a hinged door check of the same generic type, for which simple and rapid unhinging and hinging of the vehicle's door is possible without special skills and/or tools.

This is accomplished in accordance with the invention by connecting the hinge pin detachable from the first hinged part with fasteners, so that the hinged parts are separable (unhingeable) when unloosening the fasteners while keeping the connection between the hinge pin and the second hinged part and with the holding device assigned to the latter. The entire holding device can thus remain advantageously mounted on the side of the second hinged part, because even the hinge pin remains a component of the second hinged part and of the holding device's functional parts in practice. In connection with the invention, it is of essential advantage, if the fasteners are designed in such a way that the hinge pin can be fastened torque-matched to the first hinged part in only one particular relative position within the maximum relative range. For the door's initial assembly and also for each reassembly following an unhinging, this ensures that, throughout the swivelling range (approximately 70° through 80°), there is automatically always a well defined relation between the door's angular positions and the catch positions defined by the holding device. This means above all, that both the door's open position and preferably a so-called garage position (intermediate position) always remain precisely defined, because the holding device's lock-in positions are unambiguously assigned to the door's movements and angular positions by the fasteners in accordance with the invention and remain this way even after any hinging and unhinging.

In another favorable arrangement of the invention, the hinge pin is seated in a properly fitted receptacle of the first hinged part with one end secured against twisting, whereby a bolt preferably engages an end-sided axial threaded hole of the hinge pin through a hole in the first hinged part. In comparison with an alternative embodiment, (in principle even possible within the scope of the invention), in which the hinge pin has an end-sided threaded shank penetrating through and projecting over a hole and secured with a nut, the preferred embodiment of the hinged door check in accordance with the invention achieves a substantially smaller axial lift for unhinging and hinging the hinged parts. This is of special advantage in practice, because the vehicle's entire door, fastened with the corresponding hinged part, has to be moved as a rule so that a smaller lift substantially diminishes the danger of collisions between the door and other parts of the vehicle.

Further objects, features and advantages of the invention will become apparent from a consideration of the following description and the appended claims when taken in connection with the accompanying drawings.

BRIEF DESCRIPTION OF THE DRAWINGS

FIG. 7 is a perspective view of a variation of the first hinged part, differing from the embodiment of FIG. 5 with mounted hinge pin;

FIG. 9 is an enlarged side view of the hinge pin in the direction of the arrow IX from FIG. 8; an FIG. 10 is a side view of the hinge pin in the direction of the arrow X from FIG. 9.

The same parts are always given the same reference labels in the different figures drawing and each will therefore generally only be described once.

DETAILED DESCRIPTION OF THE PREFERRED EMBODIMENT

Figure 1:
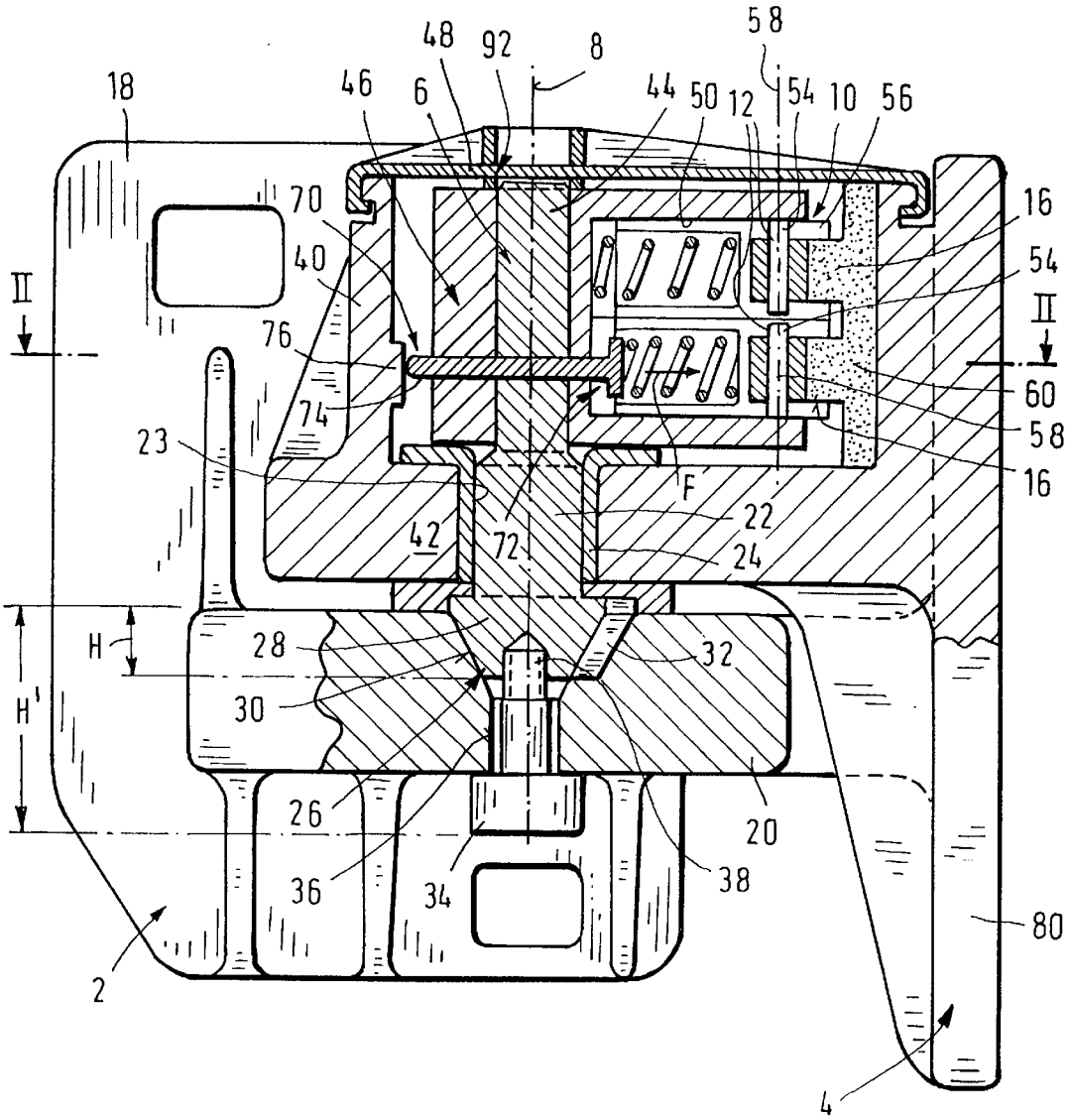
FIG. 1 is a part vertical cross section through a hinged door check in accordance with the invention in a first embodiment.

As will first be seen in FIG. 1, a hinged door check in accordance with the invention consists of a first hinged part 2 and a second hinged part 4. The two hinged parts 2, 4 are connected around an axis of rotation 8, swivelling with respect to each other, by a hinge pin 6. A holding device 10, which defines the different relative rotational positions, is integrated between the hinged parts 2, 4. For this, the holding device 10 consists first of at least one catch element 12 kinematically connected with the first hinged part 2 and spring-loaded in a working direction perpendicular to the axis of rotation 8, and secondly of a track 16 kinematically connected with the second hinged part 4, essentially shaped like the sector of a circle and arranged (see FIG. 2) coaxial to the axis of rotation 8 with respect to its radius of curvature, having at least one latching point 14 cooperating with the catch element 12. The first hinged part 2 consists of both a basically slab-shaped mounting section 18, with which the first hinged part 2 can be fastened to a particularly vertical mounting surface, and of a gibbet-like protruding supporting section 20, which is connected with the second hinged part 4 by the hinge pin 6. Proceeding from the supporting section 20 of the first hinged part 2, the hinge pin 6 only extends in one direction, namely chiefly vertically upwards. The second hinged part 4 is seated in this region, rotatable on the hinge pin 6. The hinge pin 6 has a particularly cylindrical bearing section 22 for this, which extends through a pivot bearing opening 23 of the second hinged part 4. A guide bush 24 (FIG. 6) is advantageously arranged within the pivot bearing opening 23. In its end region adjacent to the bearing section 22, the hinge pin 6 is connected torque-matched with the catch element 12. This will be explained in more detail below. The hinge pin 6 thus transmits forces or torques, so that it does not only operate as an axis, but as a shaft.

In accordance with the invention, the hinge pin 6 is detachably connected with the first hinged part 2 or with its supporting section 20 by fasteners 26, so that the hinged parts 2 and 4 are separable (i.e. unhingeable) when loosening these fasteners 26 while maintaining the connection between the hinge pin 6 and the second hinged part 4 or the catches assigned to the second hinged part 4, respectively. Here it is additionally provided in accordance with the invention, that the fasteners 26 are designed in such a way, that the hinge pin 6 can be connected torque-matched to the first hinged part 2 in only one concrete relative position to it within the maximum possible swivelling range (approximately 70° to 80°) of the hinged parts 2, 4, and thus, the vehicle door's pivoting angle). For this, the hinge pin 6, with one end 28 preferably tapering, is seated free from play, self-centering, and secured against twisting, within a properly fitted receptacle 30 of the first hinged part's 2 supporting section 20. The hinge pin's 6 end 28 has a cross section departing from the circular in order to guarantee the twist-tight connection. The illustrated example concerns a basically conical arrangement of the end 28 with a circular base cross section and with a cross-sectional extension formed by a radial rib 32. The rib 32 engages a properly shaped recess 33 (see FIG. 8 for this) within the receptacle 30 free from play. As an alternative, the hinge pin's 6 end 28 can also have a polygonal cross section, for example, or a circular base cross section with at least one cross-sectional reduction formed by a secant-like region, for example.

In connection with the unhingeability of the hinged parts 2, 4, it is advantageous for the fasteners 26 to have a bolt 34, which, through a hole 36 of the first hinged part's 2 supporting section 20, engages an axial threaded hole 38 of the hinge pin 6 sitting countersunk with the end 28 in the receptacle 30. With this advantageous arrangement, a very short axial lifting movement H suffices to separate the parts for unhinging, once the bolt 34 has been removed. It is additionally shown in FIG. 1, that, in the case of an alternative embodiment (see FIGS. 7 through 10) whereby the hinge pin 6 penetrates the hole 36 completely with a threaded shank 39 and is secured by an unillustrated nut, a larger lift H' is required to be able to remove the hinge pin from the first hinged part 2.

Figure 6:
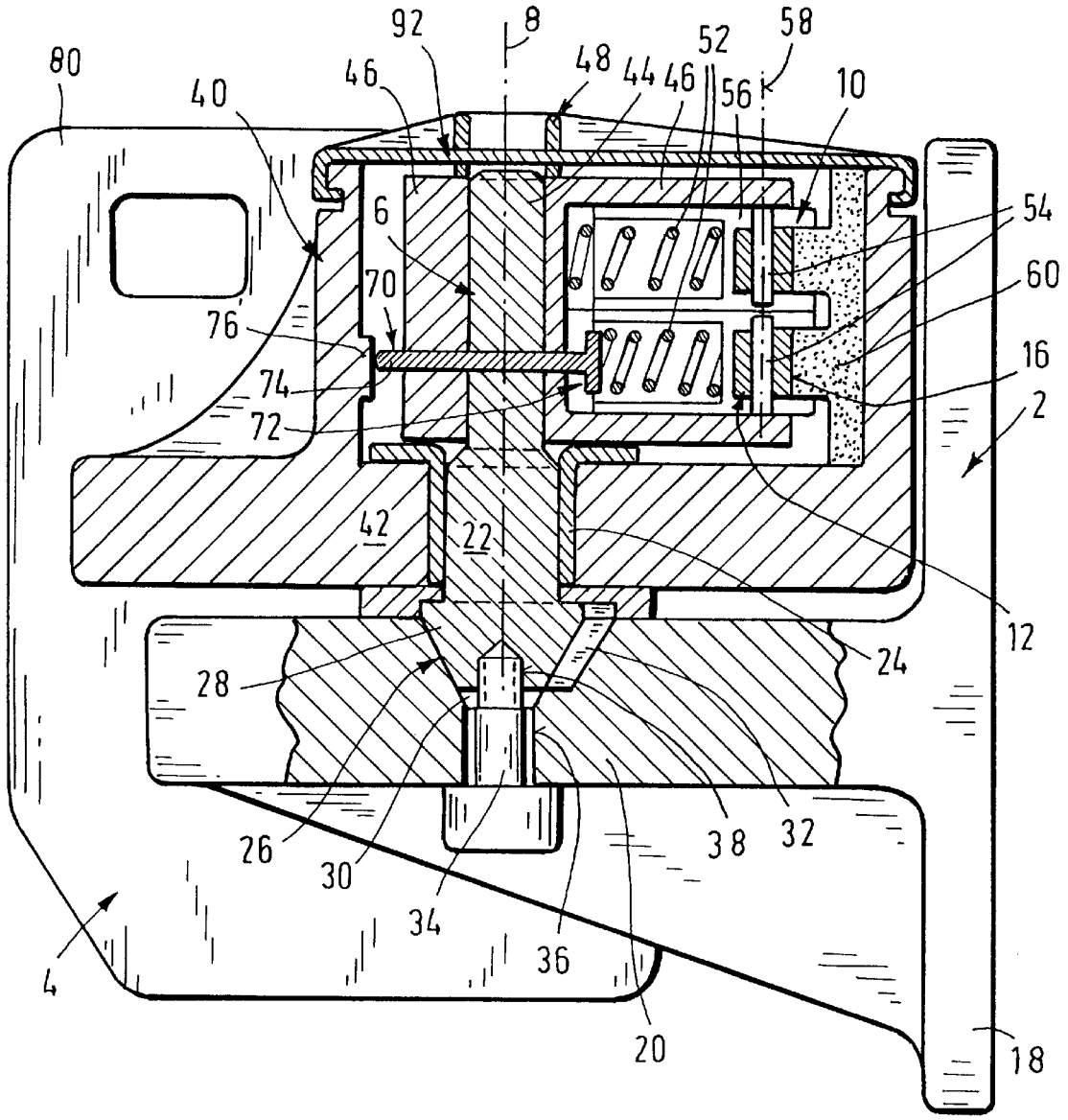
FIG. 6 is an illustration similar to FIG. 1 of another embodiment of the hinged door check in accordance with the invention.

As can also be determined from FIG. 1 and 6 respectively, the holding device 10 is placed within a housing 40 preferably designed as one piece with the second hinged part 4. The hinge pin 6 engages the housing 40 through a wall 42, which is approximately parallel to the first hinged part's 2 supporting section 20 and has the lead-through opening 23 preferably with the guide bush 24. Within the housing 40, the track 16 stationary to it is arranged on one side, and a guide part 46 is arranged on the other side, guiding the catch element 12 and connected torque-matched with a fastening section 44 of the hinge pin 6. For the torque-matched connection, the fastening section 44 has a cross section departing from a circular shape, a polygonal, indeed a quadratic cross section in the illustrated example (see FIG. 2 and FIGS. 7 through 10). On its upper side turned away from the wall 42, the housing 40 has an opening, preferably capable of being locked by a cap unit 48, for mounting the holding device's 10 functional parts. The catch element 12 is arranged in a guiding-receptacle 50 of the guide part 46, slidable in a direction perpendicular or radial to the axis of rotation 8, respectively, and is radially pressured from inside in the direction of the track 16, arranged outside, with a spring resistance F from a suspension element 52, a helical compression spring in particular. The catch element 12 is preferably designed as a roller, cylinder, or similar rotating roll barrel, and is mounted, rotatable around a rotational axis 58, parallel to the hinge's axis of rotation 8, on top of an axis 54 in a receiving part 56. The receiving part 56 is arranged in the guide part 46, slidable piston-like corresponding to the working direction. For this, refer to FIG. 2 in particular.

In another advantageous arrangement of the invention, the track 16 is formed by an insert 60 which is detachably fastened in the housing 40 and therefore interchangeable. Here the latching points 14 are designed in particular as snap-in cavities 62 with the recess's contour fitted to the catch element's 12 perimeter. The catch element 12 thereby locks into a respective snap-in cavity 62 during the relative motion of the hinged parts 2, 4. The locations of the snap-in cavities 62 are here chosen in such a way in particular, that both a completely opened open position of the vehicle's door and also preferably an approximately half-open intermediate position (so-called garage position) are defined. It is also preferably provided, that the holding device 10 defines a drawing path in the relative movement's end region, kinematically prearranged to a door's closed position, for automatic shutting of the vehicle's door. For this, in its end region prearranged to the door's closed position, the track 16 (refer again mainly to FIG. 2) has a drawing path section 64, which runs diagonally toward the outside up to a larger radius, starting from a particular inner radius of the track 16. Because of this diagonal course of the track 16 across the drawing path section 64, an automatic turning of the hinged part connected with the door is conditionally induced by the spring resistance F across the catch element 12 up to the door's closed position.

The preceding explanations hold for a "minimum embodiment" of the hinged door check in accordance with the invention, whereby one catch element 12 is sufficient in principle. It can nevertheless be advantageous for increasing the latching and retention forces, depending on the application, to provide several catch elements 12, arranged axially side by side or on top of each other, respectively, and guided in parallel. Two parallel catch elements 12 are specifically provided in the illustrated examples. The measures for guiding and for spring pressurization are valid for each of the several catch elements 12. The tracks 16 assigned to the catch elements 12 can be made from one single common insert 60, as illustrated. However, separate inserts can indeed also be provided.

The, or each, insert 60, respectively, is advantageously fastened in the housing 40 by a positive locking connection, whereby the positive locking connection is so designed, that a rigid stationary position of the catch element is achieved, particularly in the direction of motion. This can advantageously deal with an axial guide groove 64 for axial insertion and removal of the insert 60, as illustrated (see FIG. 2 in particular but also FIG. 3), a dovetail guide for example, or alternatively even T-slot guides for example.

The interchangeability of the track 16 or the insert 60, respectively, enables simple and quick adaptation to different requirements. The hinged door check can be designed for different locked-in positions and/or latching forces, for example. There additionally exists a simple and quick maintenance option.

For reliable function of the catch element 10 with low wear, it is additionally advantageous to manufacture the track 16 and the catch element 12, in the region of its peripheral surface, out of different materials, and, to be sure, out of metal with a defined roughened surface structure for the one, and out of an elastic flexible material of such a kind for the other, that a flat, contact with frictional connection is achieved between the catch element 12 and the track 16 by the elastic deformation of the flexible material. Because of this increased non-positive connection, possibly even positive locking, the catch element 12 will always roll on the track 16, so that sliding friction and its resulting wear are prevented. The catch element 12 preferably consists of metal and has the defined roughened surface structure, knurled in particular, while the track 16, preferably the entire insert 60, consists of the elastic flexible material, in particular a plastic with a hardness approximately in the range of 72 to 80 shore-D. The reader is referred to the German registered patent 296 11 819 in its full scope for this favorable arrangement.

Figure 2:
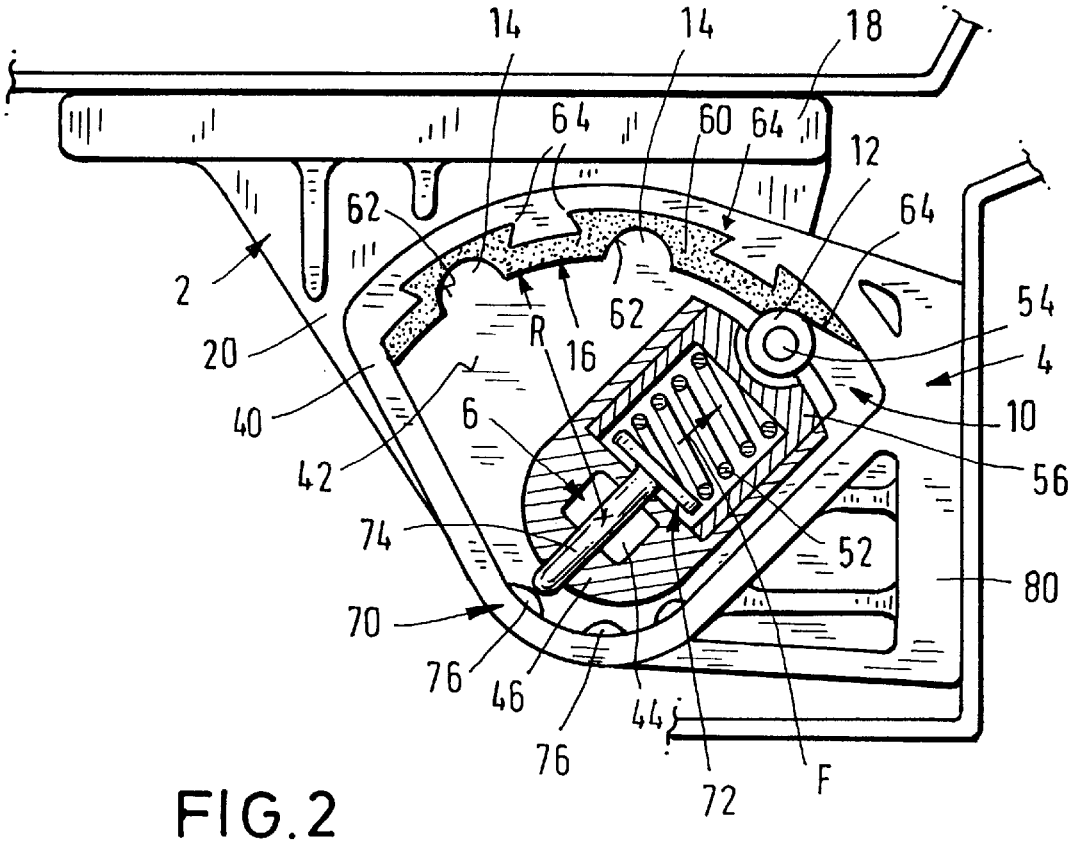
FIG. 2 is a cross section through a second embodiment of the hinged door check (corresponding approximately to the cutting plane II—II of FIG. 1)

Another favorable arrangement of the invention will now be explained on the basis of FIGS. 1, 2, and 6. The spring resistance F pressuring the catch element 12 is accordingly influenced by a controller 70 over the region of movement in such a way in particular, that the spring resistance F in the region of the latching points 14 or snap-in cavities 62, respectively, is increased and/or decreased between the latching points or snap-in cavities 62, respectively. A strengthened lock-in position can be attained in particular by this measure, and a soft movement with little wear can be guaranteed between the latching points by reducing the spring resistance. For an embodiment with several catch elements, it can be sufficient to provide this measure for only one or only a subset of the catch elements, as illustrated. From a structural point of view, the controller 70 has at least one supporting element 72 for its respective suspension element 52. This supporting element 72 consists of both a plate-like part, upon which the suspension element 52 supports itself, and a control pin 74, extending radially through holes 46*a* and 6*a* of both the guide part 46 and the hinge pin 6 in the direction opposite the suspension element 52. With its open end opposite the suspension element 52, the control pin 74 cooperates with peripheral cams 76 to increase or decrease the spring resistance F. Since the supporting element 72 is movably guided in the spring's working direction, a displacement of the spring support is attained in cooperation with the peripheral cams 76 during the relative motion. The peripheral cams 76 are each preferably located diametrically opposite the latching points. They should consist of a relatively hard, wear resistant material, and, concerning its material, make a "good friction partner" for the supporting element's 72 control pin 74. If the housing 40 consists of aluminum or similar kind of relatively "soft" material for example, then the peripheral cams 76, should be made of harder inserts, steel for example. However, the peripheral cams 76 could in principle also be molded in the housing 40 as one piece, if the pairing of materials with the control pin 74 allows this in regard to the frictional behavior. In the examples of FIGS. 1 through 6, the two hinged parts 2 and 4 are each designed as a one-piece contoured part of light metal diecasting (aluminum diecasting) or as a molded part or forging. If a light metal diecasting does not meet the required stiffness, special procedures, like vacuum diecasting or Vakural casting or even thixotrope casting are preferably to be used. A homogenous texture, which can be quench-aged by thermal treatment, is obtained by these casting procedures. A maximum apparent yielding point with a high breaking elongation can thereby be achieved.

Figures 3, 4:
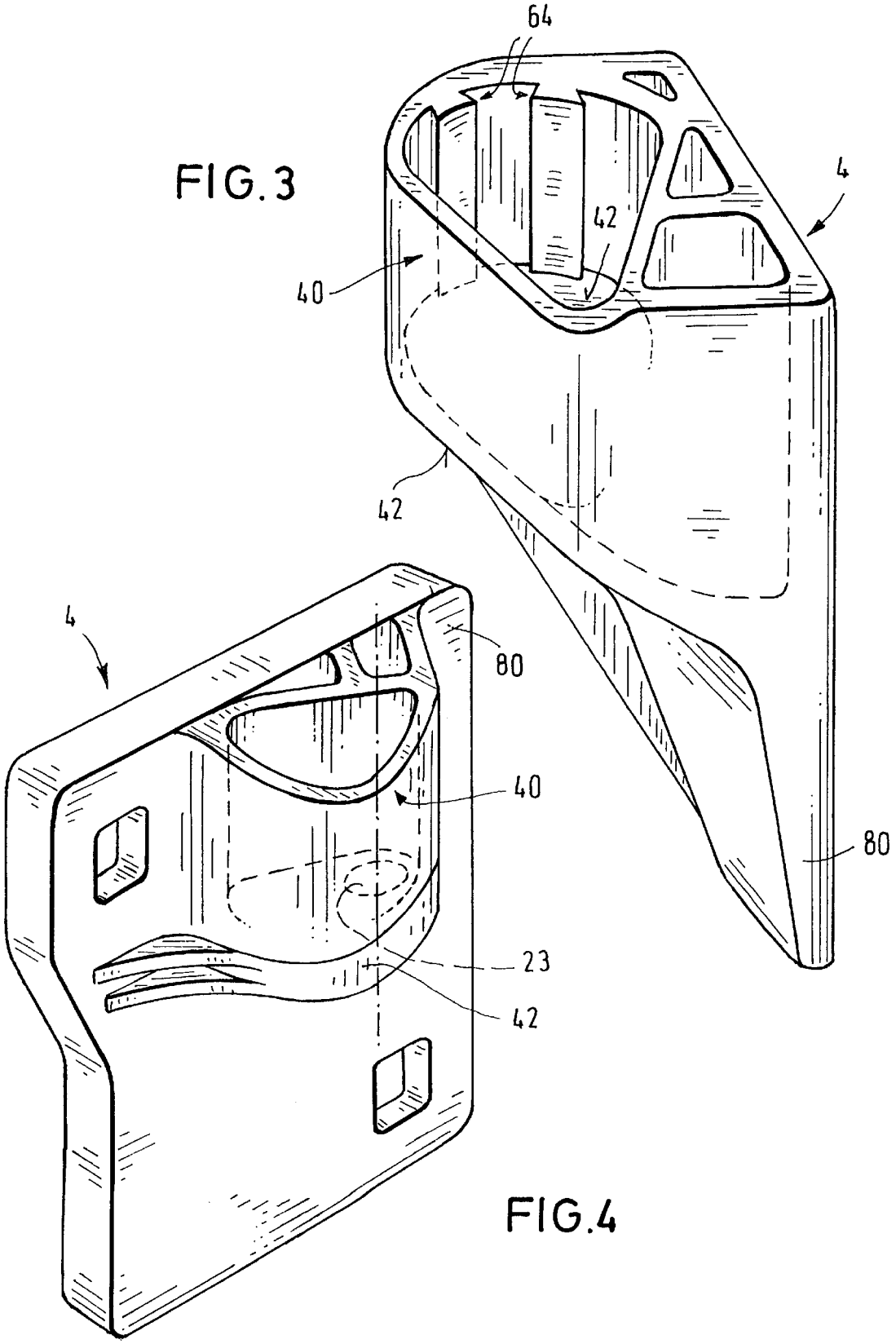
FIGS. 3 and 4 are perspective views of two different embodiments of a one-pieced contoured part of the second hinged part.
Figure 5:
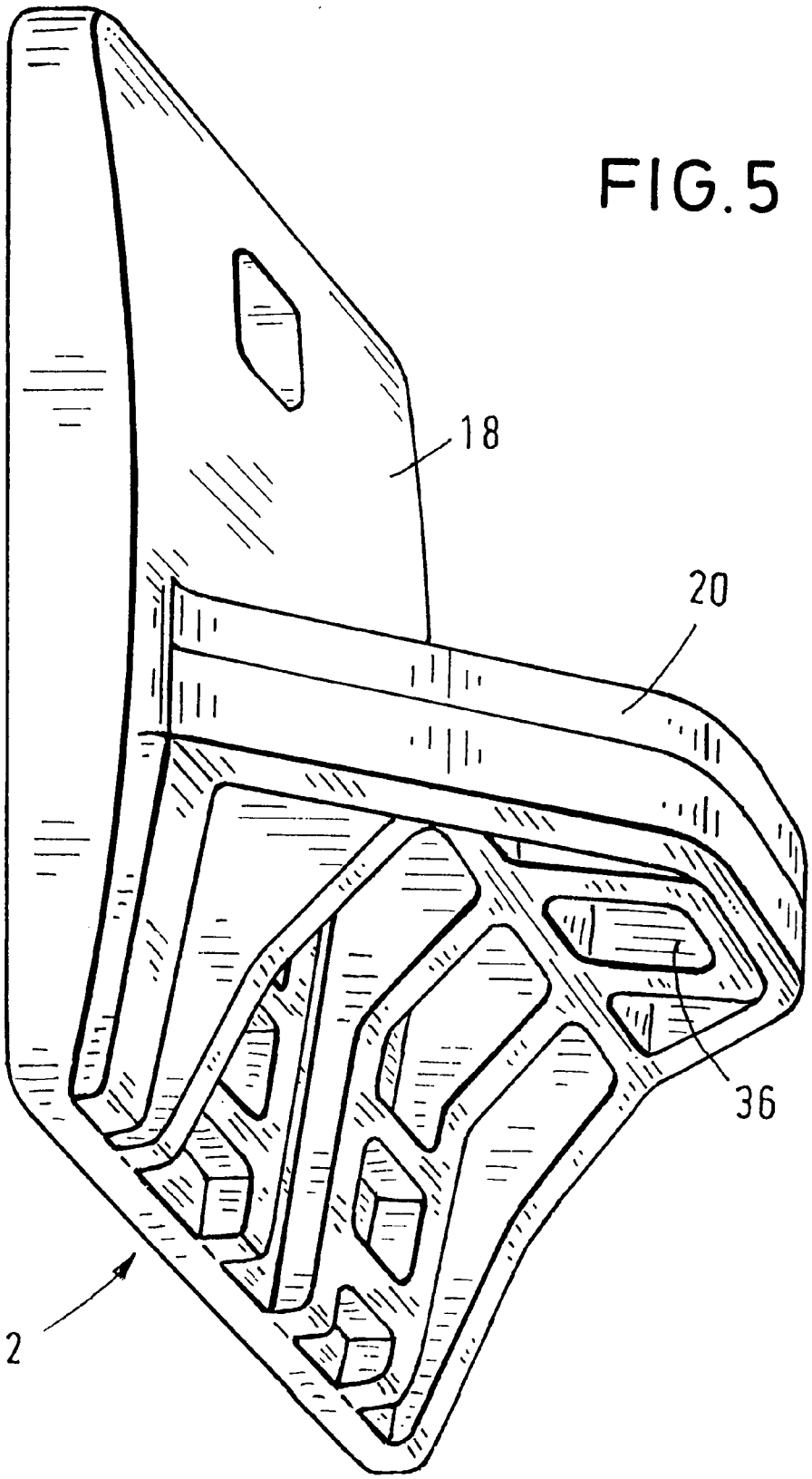
FIG. 5 is a perspective view of an example of a contoured part of the first hinged part.

For the sake of example, FIGS. 3 and 4 show two embodiments of the second hinged part. It can be seen that the housing 40 is designed as one piece with a mounting plate 80. FIG. 5 exemplarily shows an embodiment of the first hinged part 2. It becomes clear from FIGS. 3 through 5, that relatively complicated three-dimensional shapes can be realized as single-pieced contoured parts at comparatively small expense. These kinds of complicated shapes would not be able to be manufactured by forging, for example. The parts can also consist of plastic as an alternative to metal. Technically, plastics capable of high stress, fiber reinforced plastics in particular, are suitable for this.

As an alternative to the illustrated embodiments, it is also possible to manufacture each of the hinged parts 2, 4 in several pieces, out of detachably connected component parts in particular. The housing 40, for example, can form an inversely pot-like housing component (possibly jointly with the cap unit 48), which is then connected with the wall 42 or the mounting section 18.

Let it yet be mentioned, that a limit stop, which restricts the door's opening movement and in which the two parts 2, 4 come to be arranged directly next to each other by stopping elements not described in more detail, is formed between the two hinged parts 2 and 4.

For the embodiment shown in FIG. 1, the first hinged part 2 is designed for attachment to a stationary three-dimensional vehicular part (e.g. pillar or cross-tie), whereas the second hinged part 4 is to be fastened to the vehicle's swivelling door.

FIG. 6 shows a "kinematically inverted" embodiment, in which the door's first hinged part 2 and the second-hinged part 4 are assigned to the stationary vehicular part.

FIGS. 7 through 10, as opposed to FIG. 5, show a variation of the first hinged part 2 as a bent stamping consisting of steel plate. First of all, a very inexpensive manufacture is possible here. A bushing element 84, which is inserted with a basically cylindrical insert section 84*a* into a hole 86 of the supporting section 20 until it rests with a flange-like rim 84*b* on the surface of the supporting section 20, is advantageously provided to achieve a secure rigid attachment of the hinge pin 6, in spite of a material-saving, relatively thin plate thickness. On the one hand, protection against twisting exists here, for which purpose the insert section 84*a* in the illustrated example has a secant-like flattened region 84*c* (FIG. 8), and the hole 86 has a correspondingly circular cross section with a secant-like rim area 86*a*. On the other hand, the bushing element 84 is also connected material-to-material with the first hinged part's 2 supporting section 20, welded in particular. Here the bushing element 84 has the receptacle 30 with the radial recess 33 for the hinge pin's 6 end 28. The end 28 is favorably seated in the receptacle 30 depending on type of self-locking taper connection or wedging (wedge angle in the range of approximately 7° to a maximum of 14°). This also holds favorably for the embodiments according to FIGS. 1 through 6.

Figure 8:
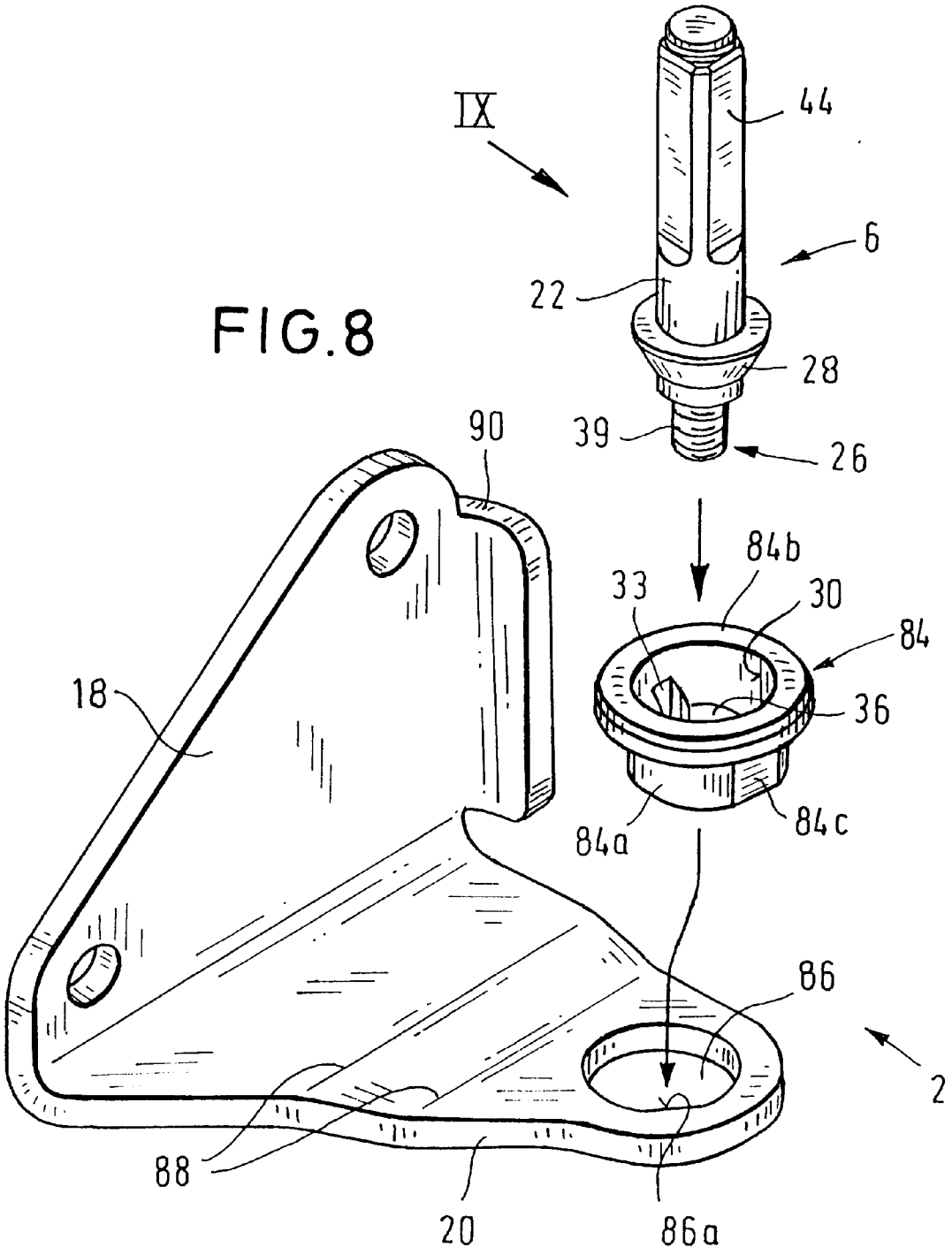
FIG. 8 is an exploded illustration of the individual parts of the embodiment of FIG. 7.

In accordance with FIGS. 7 and 8, the sheet metal hinged part 2 can be reinforced by particular measures, well known by themselves, such as crease-like curves 88 and/or folded reinforcing webs 90.

It is provided in another advantageous arrangement of the invention, that the hinge pin 6 is supported by an anchorage 92 against lateral movements due to play relative to the second hinged part 4, in its top end region axially opposite the fast connection with the first hinged part 2. This anchorage 92 is only schematically indicated in each of the FIGS. 1 and 6; it deals with a rotatable guide in the housing 40, possibly in the region of the cap unit 48. Lateral movements by the hinge pin's 6 top end region due to play, which could otherwise lead to corresponding undesired door movements in the lock-in positions, are prevented by this advantageous measure.

The following essential advantages, among others, are achieved by the arrangement in accordance with the invention:

Compact structural shape, low weight, low noise or nearly silent, simple and rapid unhinging and hinging, tight encapsulation of the holding device for protection against external influences during operation and also against a possible immersion-painting during manufacture. A very small size is additionally achieved, due to the fact that, from the entire circumference of the circle, only one segment of at most 90° is deliberately used for the track 16, and the space which is available within the vehicle can be better utilized for the catch elements' radii or levers. A relatively large radius can be used in this manner, so that a high retaining moment can be achieved with a relatively small spring resistance F. In the actualized embodiment, a radius of motion (main radius R of the track 16; cf. FIG. 2) in the range of approximately 30 to 35 mm is provided for the catch elements 12, whereby a relatively small spring resistance F is sufficient. For a structural shape as compact as possible, the aim should be for a lower value of approximately 30 mm, whereby a correspondingly higher spring resistance is to be applied to guarantee the required retaining moment. The retaining moment can certainly also be favorably influenced by a special geometry in the region of the snap-in cavities 62, particularly by small transitional radii between each snap-in cavity 62 and the adjacent region of the track 16.

The invention is not restricted to the examples illustrated and described, but includes all embodiments which work with the invention's idea. The invention is furthermore also not limited to the combination of features defined in claim 1 so far, but can also be defined by every other desired combination of particular characteristics of all disclosed individual characteristics as a whole. This means, that, in principle, practically every individual characteristic of claim 1 can be left out or replaced by at least one individual characteristic disclosed at another place in the application. Claim 1 is to be understood merely as a first attempt at formulating an invention so far.

We claim:

1. A hinged door check, for vehicle doors comprising first and second hinged parts which are connected for rotational movement around an axis of rotation by a hinge pin having first and second opposite ends and a holding device coupled to said hinged parts maintaining said hinged parts in different relative rotational positions, said holding device having at least one catch element coupled with said first hinged part, via said hinge pin, and spring-loaded in a working direction perpendicular to said axis of rotation said holding device further having a track coupled with said second hinged part, generally shaped like the sector of a circle and arranged coaxial to said axis of rotation with respect to its radius of curvature, having latching points cooperating with said catch element to define said different relative rotational positions, wherein said hinge pin is detachable from said first hinged part by a detaching fastener engageable with said first end, so that said hinged parts are separable when detaching said fastener while keeping the connection between said hinge pin and said second hinged part and said holding device, and wherein said hinge pin is supported at said second end by an anchorage against lateral movement.

2. The hinged door check according to claim 1 wherein said hinge pin can be fastened to said first hinged part in one relative position within the maximum swivelling range of said hinged parts.

3. The hinged door check according to claim 1 wherein said fastener has a bolt, which engages an axial threaded hole of said hinge pin through a hole of said first hinged part.

4. The hinged door check according to claim 1 wherein said fastener comprises of an end-sided threaded shank of said hinge pin guided through a hole of said first hinged part and secured with a nut.

5. The hinged door check according to claim 1 wherein said hinge pin, with said first end tapering, is seated free from play, self-centering, and secured against twisting, within a receptacle of said first hinged part.

6. The hinged door check according to claim 5 wherein said first end of said hinge pin has a cross section selected from the group consisting of a polygonal cross section or a circular base cross section with at least one cross-sectional extension formed by a radial rib or with at least one cross-sectional reduction formed by an approximately secant-like region.

7. The hinged door check according to claim 5 wherein said hinge pin is seated in said receptacle by a self-locking taper connection.

8. The hinged door check according to claim 1 wherein said hinge pin rotates in said second hinged part with a bearing section.

9. The hinged door check according to claim 1 wherein said holding device is placed within a housing connected with said second hinged part, whereby said, and a guide part guiding said catch element and connected with said hinge pin are arranged within said housing.

10. The hinged door check according to claim 8 wherein said catch element is arranged slidable into a guiding receptacle of said guide part in a direction radial to said axis of rotation, and is pressured with spring resistance by a suspension element toward said track.

11. The hinged door check according to claim 9 wherein said catch element is a roller and is mounted rotatable around a rotational axis, parallel to the hinge's said axis of rotation, on top of an axis in a receiving part arranged piston-like in said guide part.

12. The hinged door check according to claim 8 wherein said track is formed by an insert detachably fastened in said housing, whereby said latching points are designed as snap-in cavities with contour fitted to said catch element.

13. The hinged door check according to claim 1 wherein said track and said catch element consist of different materials said different materials comprising metal with a defined roughened surface structure and an elastic flexible material whereby a frictional connection is achieved between said catch element and said track by the elastic deformation of the flexible material.

14. The hinged door check according to claim 13 wherein said catch element consists of metal and has the defined roughened surface structure, while said track consists of the elastic flexible material.

15. The hinged door check according to claim 1 wherein said holding device defines a path of movement.

16. The hinged door check according to claim 15 wherein said track of said holding device has a drawing path section, which runs diagonally toward the outside up to a larger radius, starting from an inner radius, whereby said door is induced to close.

17. The hinged door check according to claim 1 wherein each of said first and second hinged parts are designed as a one-piece contoured part selected from the group of materials consisting of plastic, metal, or light metal diecasting.

18. The hinged door check according to claim 1 wherein said first hinged part is made of bent sheet metal, whereby a bushing element is attached to said first hinged part for the connection with said hinge pin.

19. The hinged door check according to claim 1 wherein said first hinged part is assigned to a stationary three-dimensional vehicular part and said second hinged part is assigned to a swivelling door.

20. The hinged door check according to claim 1 wherein said first hinged part is assigned to the swivelling door and said second hinged part is assigned to a stationary three-dimensional vehicular part.

21. The hinged door check according to claim 1 wherein said holding device has at least two axially adjacent catch elements.

22. A hinged door check, for vehicle doors comprising first and second hinged parts which are connected for rotational movement around an axis of rotation by a hinge pin having first and second opposite ends and a holding device coupled to said hinged parts maintaining said hinged parts in different relative rotational positions, said holding device having at least one catch element coupled with said first hinged part and spring-loaded in a working direction perpendicular to said axis of rotation, said holding devices further having a track coupled with said second hinged part, generally shaped like the sector of a circle and arranged coaxial to said axis of rotation with respect to its radius of curvature, having at least one latching point cooperating with said catch element to define said different relative rotational positions, wherein said hinge pin is detachable from said first hinged part by a detaching fastener engageable with said first end, so that said hinged parts are separable when detaching said fastener while keeping the connection between said hinge pin and said second hinged part and said holding device and wherein a spring resistance pressuring said catch element is biased by a controller in a range of travel to produce a reinforced lock-in position in the region of said latching points.

23. A hinged door check, for vehicle doors comprising first and second hinged parts which are connected for rotational movement around an axis of rotation by a hinge pin having first and second opposite ends and a holding device coupled to said hinged parts maintaining said hinged parts in different relative rotational positions, said holding device having at least one catch element coupled with said first hinged part and spring-loaded in a working direction perpendicular to said axis of rotation, said holding devices further having a track coupled with said second hinged part, generally shaped like the sector of a circle and arranged coaxial to said axis of rotation with respect to its radius of curvature, having at least one latching point cooperating with said catch element to define said different relative rotational positions, wherein said hinge pin is detachable from said first hinged part by a detaching fastener engageable with said first end, so that said hinged parts are separable when detaching said fastener while keeping the connection between said hinge pin and said second hinged part and said holding device and wherein spring element pressuring said catch element is supported on a first side by a supporting element arranged movable in the spring's working direction in said guide part, whereby, on a second side opposite said suspension element, said supporting element couples with peripheral cams to increase or decrease the spring resistance.

* * * * *